US006662504B2

(12) United States Patent
Krogstad

(10) Patent No.: US 6,662,504 B2
(45) Date of Patent: Dec. 16, 2003

(54) FLASHING AND WEEP/VENT SYSTEM FOR A MASONRY WALL

(76) Inventor: Norbert V. Krogstad, 928 E. Morris Dr., Palatine, IL (US) 60067

( * ) Notice: Subject to any disclaimer, the term of this patent is extended or adjusted under 35 U.S.C. 154(b) by 44 days.

(21) Appl. No.: 09/837,110

(22) Filed: Apr. 18, 2001

(65) Prior Publication Data

US 2002/0152693 A1 Oct. 24, 2002

(51) Int. Cl.[7] ..... E04D 13/15
(52) U.S. Cl. ..... 52/61; 52/62; 52/97
(58) Field of Search ..... 52/58, 60, 61, 52/62, 94, 95, 96, 97, 169.5, 408; 220/6; 229/117.05, 117.07

(56) References Cited

U.S. PATENT DOCUMENTS

| | | | | |
|---|---|---|---|---|
| 3,293,810 A | | 12/1966 | Cox et al. | |
| 3,429,084 A | | 2/1969 | Brewer | |
| 3,668,811 A | * | 6/1972 | Pollard | 52/94 |
| 4,587,891 A | | 5/1986 | Kruse | |
| 4,910,931 A | | 3/1990 | Pardue, Jr. | |
| 5,203,795 A | | 4/1993 | Balamut et al. | |
| 5,274,968 A | | 1/1994 | Pardo | |
| 5,349,792 A | * | 9/1994 | Bayes | 52/62 |
| 5,472,107 A | * | 12/1995 | Lieber | 220/6 |
| 5,815,986 A | | 10/1998 | Laska | |
| 5,870,864 A | * | 2/1999 | Snyder et al. | 52/169.5 |
| 6,023,892 A | | 2/2000 | Sourlis | |
| 6,052,959 A | * | 4/2000 | LaBrosse | 52/302.6 |

OTHER PUBLICATIONS

Excerpt from website of Hohmann & Barnard, Inc. (www.h–b.com).
Excerpt from website of Hyload, Inc. (www.hyloadflashing-.com).
Excerpt from website of Blok–Flash (www.block–flash-.com).

* cited by examiner

*Primary Examiner*—Carl D. Friedman
*Assistant Examiner*—Naoko Slack
(74) *Attorney, Agent, or Firm*—Wood, Phillips, Katz, Clark & Mortimer

(57) ABSTRACT

The combination of: a) a first water collection section for a masonry wall having a first bottom wall, a first back wall, and a first side wall bounding a first collection space; b) a second water collection section for a masonry wall having a second bottom wall, a second back wall, and a second side wall bounding a second collection space; and c) a first connector for joining the first and second water collection sections to maintain the first and second water collection sections in an operative relationship.

45 Claims, 14 Drawing Sheets

FLASHING AND WEEP/VENT SYSTEM FOR A MASONRY WALL

FIELD OF THE INVENTION

This invention relates to masonry walls and, more particularly, to a system for facilitating discharge of moisture from internally to externally of the wall and for providing a weep/vent passageway through the wall.

BACKGROUND ART

In constructing masonry walls, provision is generally made to collect and discharge accumulated moisture at the base thereof to the external environment and also to evaporate and discharge internal moisture by inducing air flow in a space, as between a masonry veneer and an external wall. If this moisture is not eliminated, water may accumulate within masonry walls, leading to deterioration of masonry materials or metal embedments, and/or water may cause leakage or moisture problems in the building interior. Many water leakage and moisture problems in buildings are attributable to a failure to adequately discharge moisture from the wall. Even if water does not reach interior spaces, it may account for unwanted internal humidity or may cause structural damage through the promotion of corrosion, rot or mold and mildew.

Weep vents are commonly used and dimensioned to be strategically located between adjacent bricks to provide a path through the masonry wall to promote air circulation. Heretofore, metal, plastic or composite flashings have commonly been used at the base to direct water within the wall back to the exterior. A typical rigid metal flashing section consists of a formed copper, prefinished aluminum, or stainless steel, sheet. A typical plastic or composite flashing consists of a flexible material that conforms to the shape of the supporting elements. The flashing is supported by a foundation, or in the case of masonry above the first floor, by shelf angles or other structural components. The flashing projection may have a downturned lip which directs externally moving water over and past the external face of the masonry wall.

The flashing sections are joined, end-to-end, to form an uninterrupted barrier across the desired wall dimension. Adjacent sections are lapped, one over the other. It is important that this lapped connection be water tight so that moisture does not migrate between the lapped portions and thereby bypass the flashing system. Conventionally, to leakproof this joint, a waterproof adhesive or sealant is utilized. However, this lapped joint arrangement and the use of a waterproof adhesive have a number of drawbacks.

First of all, it is difficult to consistently create watertight flashing joints. Adhesives adhere effectively only to dry and clean surfaces. Accordingly, the surfaces to be adhered may have to be prepared before the application of the adhesive, which represents an inconvenience and added worker time. Also, many of the materials used in conjunction with masonry or other wall systems generate dust. This makes it very difficult to maintain a clean environment for the application of adhesives or sealants.

Still further, the construction may take place in an environment, or on days, where moisture is present, making it all but impossible to properly prepare the mating surfaces for the use of the adhesive. As a consequence, the integrity of the joint between one or more of the sections may be compromised, as a result of which water may leak into the interior or contribute to deterioration of the wall system.

Repair of flashing failures may be very expensive because it often involves demolition of all or a part of the masonry wall to repair flashings.

Additionally, the need to apply an adhesive or sealant on site is inherently inconvenient. Supplies of the adhesive or sealant must be kept on hand, usually in sealable containers or in tubes. Most adhesives and sealants have limited shelf life and must be discarded after the expiration date. At the time of the application, the containers must be opened and some applying instrument must be utilized, as in the form of a brush or spreading knife. Aside from this inconvenience, adhesive inevitably detrimentally finds its way onto the workers' hands and clothing and potentially onto exposed portions of the building, which must then be cleaned.

Because the adhesives are not only messy but may be caustic, it is common for workers applying the adhesive to use gloves. With gloves worn, it may be more difficult for the workers to conveniently handle the sections and to effectively apply the adhesive and establish a leakproof joint between adjacent sections.

A second problem can occur when installing short lengths of flashings above openings. These flashings should be constructed with turned up portions at the ends to prevent water from flowing off the ends and remaining within the walls. Installation of these "end dams" can present problems. If the edge of the flashing projects beyond the face of the wall, it can be unsightly. If it does not project fully to the face, water reaching the flashing can flow around the front edge of the end dam and, as a result, remain within the wall.

SUMMARY OF THE INVENTION

In one form, the invention is directed to the combination of: a) a first water collection section for a masonry wall having a first bottom wall, a first back wall, and a first side wall bounding a first collection space; b) a second water collection section for a masonry wall having a second bottom wall, a second back wall, and a second side wall bounding a second collection space; and c) a first connector for joining the first and second water collection sections to maintain the first and second water collection sections in an operative relationship.

The first connector may be separate from each of the first and second water collection sections.

In one form, the first connector defines a venting passageway.

In one form, with the first and second water collection sections in the operative relationship, the first and second side walls are adjacent to each other. Each of the first and second side walls has an upper edge and the first connector straddles the first and second side wall sections at the upper edges of the first and second side walls.

In one form, the first water collection section is reconfigurable selectively between an operative state and a collapsed state. The first water collection section is reconfigured from the operative state towards the collapsed state by folding the first side wall and first back wall downwardly towards the first bottom wall.

There may be a hinge line between the first side wall and first bottom wall and between the first back wall and first bottom wall to facilitate relative folding between the first bottom wall, the first side wall, and the first back wall.

The combination may further include a diverting connector which extends around the upper edges of the first and second back walls with the first and second water collection sections in the operative relationship and the diverting connector in an operative position.

In one form, the diverting connector has an upwardly facing surface which bridges the first and second side walls with the first and second water collection sections in the operative relationship and the diverting connector in the operative position. The diverting connector diverts downwardly moving water from passage between the first and second side walls.

The combination may further include a sheet layer which depends from a location above the first and second water collection sections and extends in front of the diverting connector to a location below the upper edges of the first and second back walls to direct downwardly moving water towards the first and second water collection sections.

In one form, at least a portion of the sheet layer terminates above the upwardly facing surface of the diverting connector so that downwardly moving water is directed by the sheet layer to against the upwardly facing surface of the diverting connector.

In one form, a portion of the first connector overlies the upwardly facing surface of the diverting connector.

The first connector may have a wall with a solid upwardly facing surface which bridges the upper edges of the first and second side walls to block passage of downwardly moving water to between the first and second side walls.

In one form, the first connector has a plurality of vertically spaced surfaces at the front thereof. The vertically facing surfaces may decline from rear to front.

In one form, the diverting connector has a front wall which vertically spans substantially the entire, or a part of, the vertical extent of the first and second back walls and a U-shaped upper portion which wraps around the upper edges of the first and second back walls with the first and second water collection sections in the operative relationship and the diverting connector in the operative position.

The, upwardly facing surface on the diverting connector may terminate at an upturned flange.

The first water collection section may be made from at least one of plastic, metal, composite material, or the like.

In one form, the first water collection section has a third side wall which is spaced from the first side wall.

In one form, the first side wall has a first flat surface and the third side wall has a third flat surface and the first and third flat surfaces are substantially parallel to each other.

In one form, the first bottom wall has a front and rear and a downwardly bent lip at the front of the bottom wall.

In one form, the bottom wall has a downwardly bent lip defining a forward edge, the first side wall has a lower portion, and the lower potion of the first side wall projects forwardly to or beyond the forward edge of the downwardly bent lip.

The first connection may have a projecting nose that extends over and conceals the lower portion of the first side wall that projects forwardly to or beyond the forward edge of the downwardly bent lip.

In one form, with the first and second water collection sections in the operative relationship, the first and second side walls are spaced from each other by a predetermined distance.

The first connector has a body defining a receptacle with a width that is slightly greater than the predetermined distance.

The combination may further include a plurality of masonry elements fixed to each other within the first collection space.

In one form, the combination includes a plurality of masonry elements fixed to each other within the second collection space. The body of the first connector has a width. The masonry elements are spaced from each other by a second predetermined distance in each of the first and second collection spaces. The first connector resides between a masonry element in the first collection space and a masonry element in the second collection space and the width of the body of the first connector is substantially equal to the second predetermined distance.

In one form, the diverting connector is made from at least one of plastic and metal.

The diverting connector has a front wall which may have an opening therethrough.

In one form, the diverting connector has a horizontally extending wall portion defining the upwardly facing surface and the front wall has at least one flange which reinforces the horizontally extending wall on the diverting connector.

In one form, the flange bounds the opening formed through the front wall portion on the diverting connector.

The invention is also directed to a method of forming a water collection structure for installation at the bottom of a masonry wall. The method includes the steps of: placing first and second water collection sections, each having a bottom wall and a wall structure extending upwardly from the bottom wall, in an operative relationship at a location at which masonry elements are to be placed; and press-fitting a first connector to the first and second water collection sections to thereby maintain the first and second water collection sections in the operative relationship.

The method may further include the step of press-fitting a second connector to the first and second water collection sections so that the second connector diverts downwardly moving water so as not to pass between and under the first and second water collection sections.

The second connector may be press fit by direction downwardly against the wall structure.

The first connector may be press fit by direction downwardly against the wall structure.

The method may further include the step of reconfiguring the first water collection section prior to press-fitting the first connector to the first and second water collection sections.

In one form, the first water collection section has an operative state and a collapsed state and the first connector is press fit to the first water collection section with the first water collection section in the operative state. The first water collection section is changeable from the operative state towards the collapsed state by folding the wall structure downwardly toward the bottom wall.

The step of reconfiguring may involve changing the first water collection section from the collapsed state into the operative state.

The method may include the step of shipping a plurality of water collection sections, having the same configuration as the first water collection section, to a site at which the masonry wall is to be constructed, with the plurality of water collection sections in the collapsed state and stacked one against the other.

In one form, no separate fasteners or adhesives are used to maintain the first connector and either the first or second water collection sections together.

The invention is also directed to the combination of a first water collection section for a masonry wall having a first bottom wall, a first back wall, and a first side wall bounding a first collection space, and a first connector for engaging the first side wall and joining the first water collection section to another water collection section to maintain the first and another water collection sections in an operative relationship. The first bottom wall has a downturned lip defining a forward edge. The first side wall has a lower portion projecting forwardly to or beyond the forward edge of the downwardly bent lip. The connector has a projecting nose which covers the lower portion of the first side wall projecting forwardly to or beyond the forward edge of the downwardly bent lip.

DETAILED DESCRIPTION OF THE DRAWINGS

Figure 1:
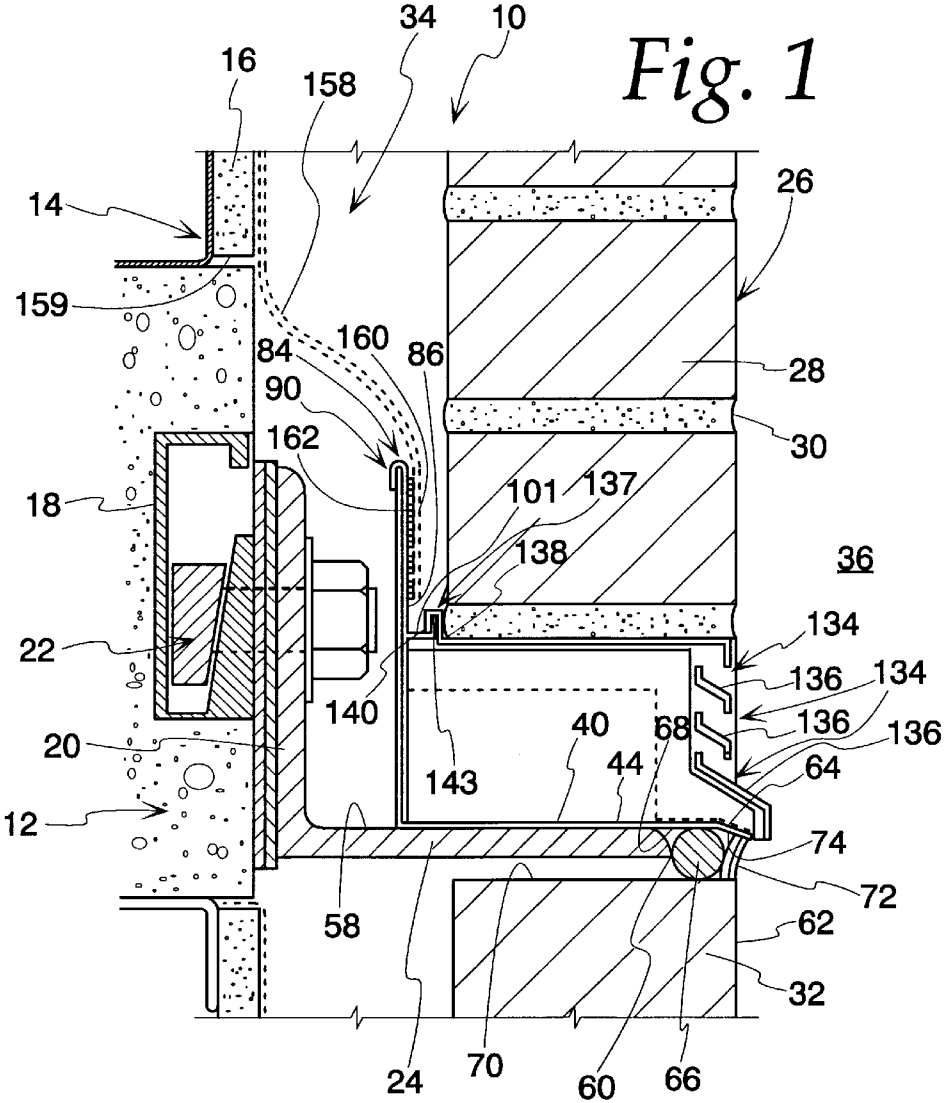
FIG. 1 is a cross-sectional view of one type of wall system wherein the present invention may be used, including a backup wall and a brick veneer, with water collection sections, according to the present invention, installed therein and maintained together in operative relationship by a first connector and a diverting connector.

In FIG. 1, an exemplary environment for the present invention is shown as part of a masonry/brick veneer over steel stud wall system at 10. It should be understood that the masonry wall system 10 is but one exemplary environment for the present invention, as it is useable with virtually any wall or wall system in which water seepage is to be controlled.

The wall system 10 is integrated into a concrete slab 12. On top of the slab 12, a steel stud backup wall at 14 is mounted. Sheathing 16 is conventionally attached to the steel stud backup wall 14. A bolt insert 18 is cast into the concrete slab 12 and serves to support a shelf angle 20 through bolts 22. A horizontal leg 24 of the shelf angle 20 serves to support a masonry veneer 26, which in this case is made up of bricks 28 held in place by mortar 30. It is possible that elements other than masonry elements would be used according to the present invention, and thus the description of the exemplary masonry elements herein should not be viewed as limiting. A base 32, which may be the top of a masonry veneer for a floor below or a foundation wall at the first floor, is subjacent the horizontal leg 24 of the shelf angle 20 and spaced slightly therefrom in a vertical direction. The veneer 26 is situated so that there is a continuous space 34 between the veneer 26 and the backup wall 14. The present invention is designed to define a circulating air pathway between the space 34 and the external environment 36 and also to collect seepage water and direct the accumulated seepage water to the external environment 36 from the space 34 and from within the veneer 26.

Figure 2:
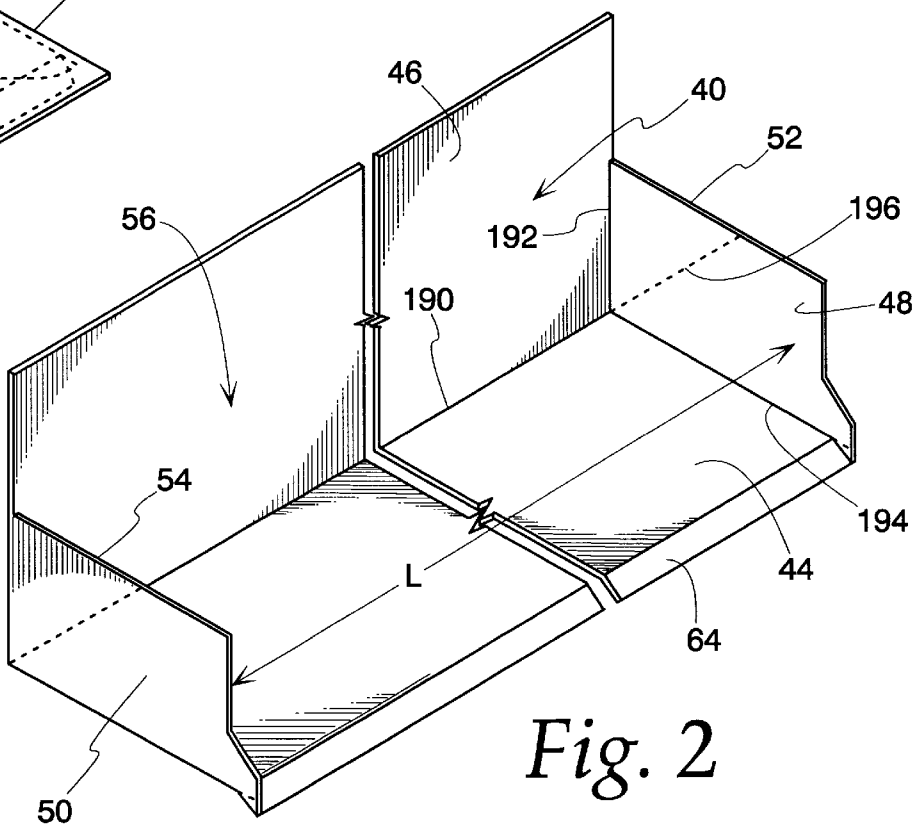
FIG. 2 is a perspective view of a straight water collection section, according to the present invention, in an operative state.
Figure 3:
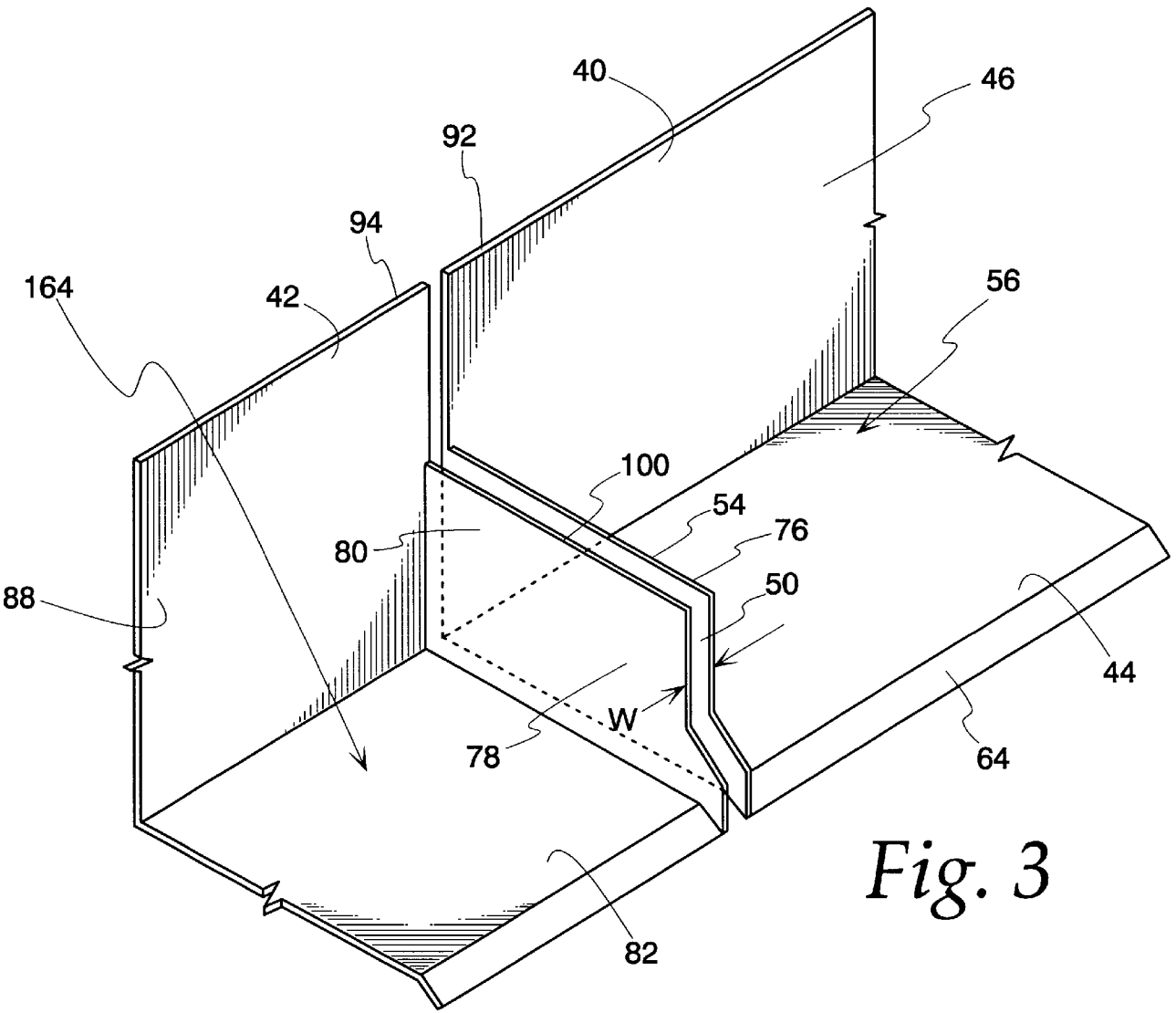
FIG. 3 is an enlarged, fragmentary, perspective view of two water collection sections, as in FIG. 2, in an operative state and in operative relationship with each other.
Figure 4:
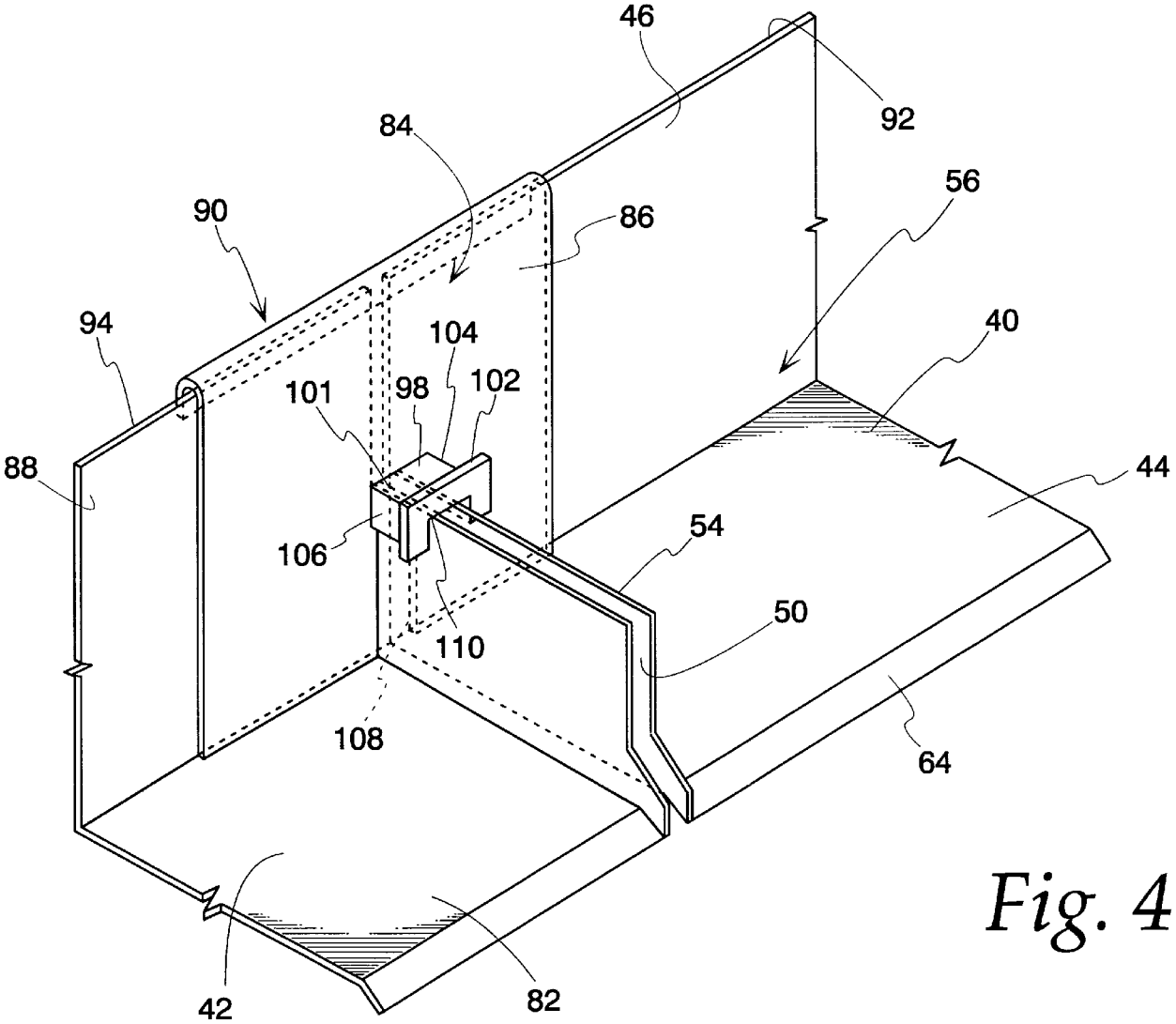
FIG. 4 is a view as in FIG. 3 with the diverting connector press fit into place.
Figures 5, 17:
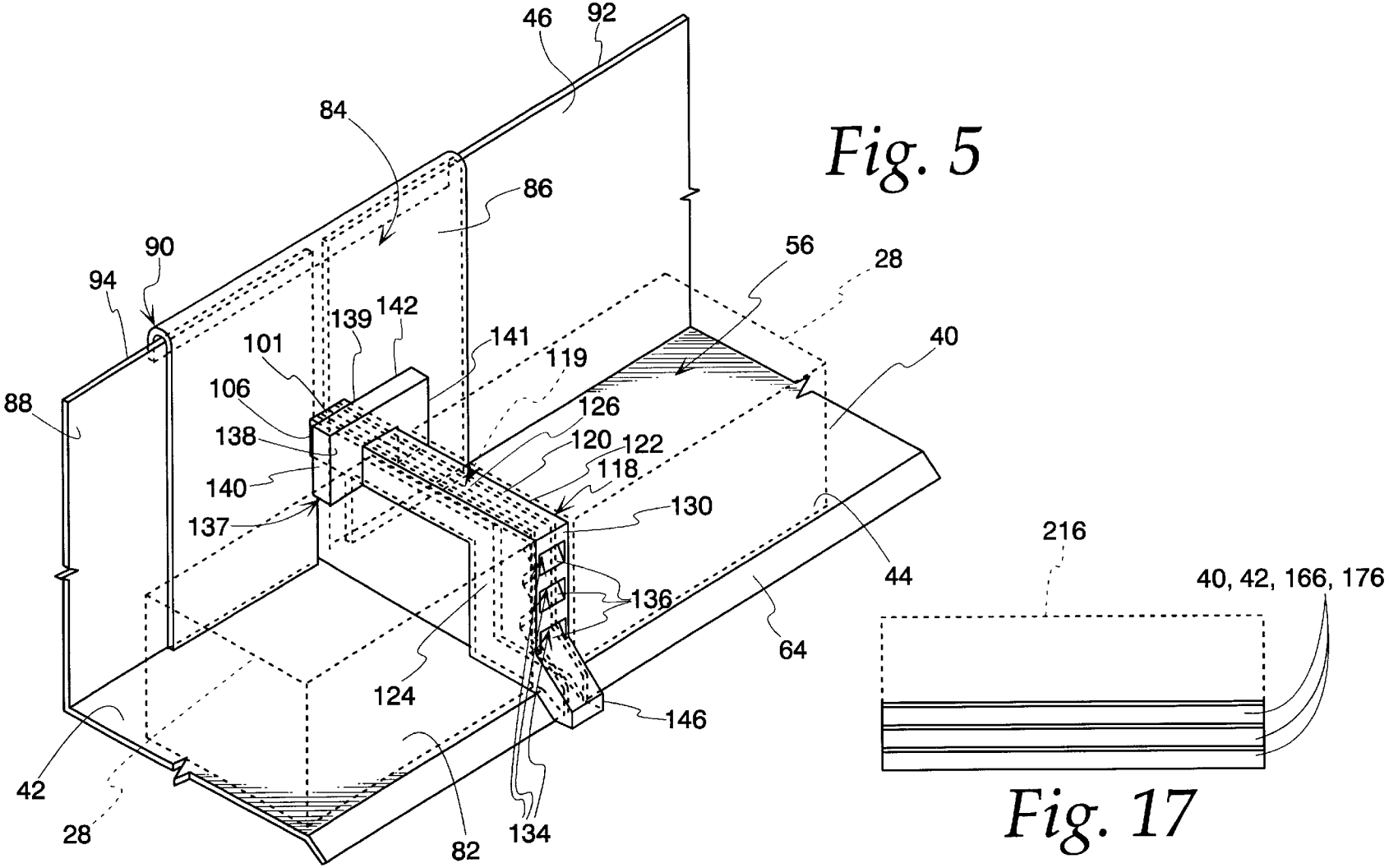
FIG. 5 is a view as in FIG. 4 with the first connector press fit into place.
FIG. 17 is a reduced, side elevation view of a plurality of water collection sections, according to the invention, in a collapsed state and stacked in a package for transportation thereof.

Referring initially to FIGS. 2–5, first and second water collection sections 40, 42 are shown in an operative state and in operative relationship in FIGS. 3–5. In this embodiment, the water collection sections 40, 42 have an identical construction. Exemplary water collection section 40 consists of a substantially flat bottom wall 44 and a wall structure extending upwardly therefrom and consisting of a substantially flat back wall 46 that is orthogonal to the bottom wall 44, and spaced, substantially flat, side walls 48, 50, which are orthogonal to the bottom and back walls 44, 46. The lower portions of the side walls 48, 50 preferably project to, or beyond, the forward edge of the down turned lip 64. The back wall 46 extends vertically above the top edges 52, 54 of the side walls 48, 50. The walls 44, 46, 48, and 50 cooperatively bound and define a water collection space 56.

As seen also in FIG. 1, the water collection section 40 is installed by placement against an upwardly facing surface 58 on the shelf angle leg 24. In the installed position, shown in FIG. 1, the bottom wall 44 projects forwardly beyond the forward free end 60 of the shelf angle leg 24 sufficiently to extend forwardly past the front 62 of the top of the veneer of the base 32 at the floor below or a foundation wall at the first floor 32. The forward portion of the bottom wall 44 has a downturned lip 64 which directs water in the collection space 56 downwardly past and away from the front 62 of the base 32. A backer rod 66 is installed beneath the bottom wall 44 and simultaneously abuts the free end 60 of the shelf angle leg 24, the underside 68 of the bottom wall 44, and a top surface 70 of the base 32. A conventional sealant element 72 spans between the underside 74 of the lip 64, the backing rod 66, and the top surface 70 of the wall below 32 to prevent migration of water from the external environment 36 internally from beneath the water collection section 40.

Referring again to FIGS. 3 and 4, the water collection sections 40, 42 in their operative relationship are installed side-to-side on the surface 58. The dimension W (FIG. 3) between the inside surface 76 of the side wall 50 on the collection section 40 and the inside surface 78 of the side wall 80 projecting upwardly from a bottom wall 82 on the collection section 42, and corresponding to the wall 48 on the collection section 40, is set to accommodate some dimensional tolerance between adjacent collection sections 40, 42.

Figure 6:
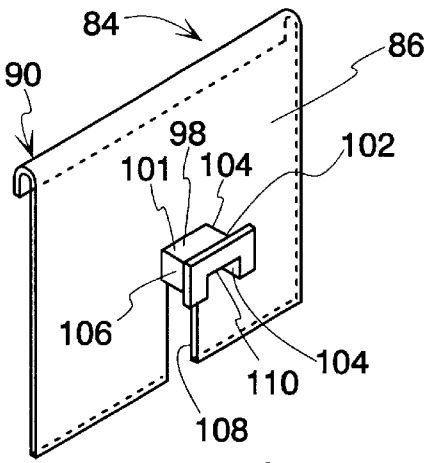
FIG. 6 is a perspective view of the diverting connector.
Figure 7:
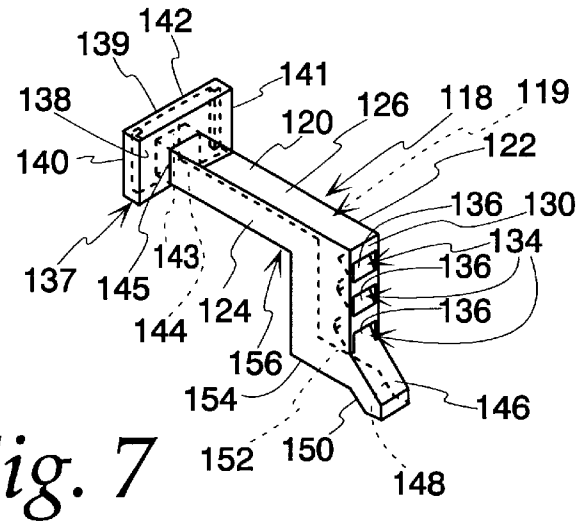
FIG. 7 is a perspective view of the first connector.

With the water collection sections 40, 42 in the operative relationship of FIG. 3, a diverting connector 84 is installed. The diverting connector 84, as also seen in FIG. 6, has a vertical front wall 86, which either spans the entire vertical extent of the back wall 46 of the collection section 40, and the corresponding back wall 88 of the collection section 42, or can terminate at another vertical location. The diverting connector 84 has an inverted, U-shaped upper portion 90 which wraps around the upper edges 92, 94 of the back walls 46, 88 on the collection sections 40, 42 with the diverting connector 84 in the operative position of FIGS. 1, 4 and 5.

The diverting connector 84 further has a cantilevered wall 98 projecting from a location that will occur just above the top edges 54, 100 of the side walls 50, 80. The cantilevered wall defines a solid, upwardly facing surface 101 which bridges the top edge 54 on the side wall 50 on the water collection section 40. The wall 98 terminates at an upturned flange 102. The wall 98 has downturned ends 104, 106 which straddle the walls 50, 80 and depend from the horizontally extending portion of the wall 98 so as to direct downwardly moving water intercepted by the surface 101 downwardly over the side walls 50, 80. Preferably, the front wall 86 extends downwardly at least as far as the bottom edges of the wall ends 104, 106, to effect reinforcement thereof. The wall surface 101 shields the space between the side walls 50, 80 from downwardly moving water.

The vertical front wall 86 of the diverting connector 84 has an opening 108 formed therethrough. The wall ends 104, 106 frame the opening 108 and connect to the front wall 86 and horizontally extending portion of the wall 98. The flange 102 has an edge 110 having an inverted U shape which conforms to the combined shape of the wall 98 including its downturned ends 104, 106.

It is possible to form the entire diverting connector 84 in one piece in a plastic molding process. Alternatively, the diverting connector 84 can be made from metal or other material that is deformable to produce the shape shown.

As seen in FIGS. 1–5 and 7, the water collection sections 40, 42 are maintained in the operative relationship additionally by a connector 118 which may be a weep connector. The weep connector 118 is preferably formed as an element separate from both the water collection sections 40, 42. Aside from maintaining the operative relationship between the water collection sections 40, 42, the weep connector 118, in conjunction with the diverting connector 84 and side walls 50, 80, also defines a weeping and venting passageway 119 from the external environment 36 through the veneer layer 26 to the space 34.

The weep connector 118 has a body 120 with spaced side walls 122, 124 joined by a top wall 126. The walls 122, 124, 126 cooperatively define a U shape. The weep connector 118 has a front wall 130 with vertically spaced vent openings 134 therethrough. Each vent opening 134 has an associated flow directing surface 136, with the surfaces 136 declining from rear to front.

The weep connector 118 has a rear attachment portion 137 to engage and interlock with the wall 98 and associated flange 102 on the diverting connector 84. The attachment portion 137 has a squared, hollow shape with spaced front and rear walls 138, 139, side walls 140, 141, and atop wall 142. The flange 102 nests in a receptacle 143 bounded by the walls 138, 139, 140, 141, 142 with the flange 102 abutted to the underside of the top wall 142 within the receptacle 143. The front and rear walls 138, 139 have openings 144, 145 therethrough so that the passageway 119 is continuous through the top of the connector body 120 and the attachment portion 137. The opening 145 is configured to receive the wall 98 so that the wall 98 and flange 102 interlock with the attachment portion 137 to thereby maintain the connectors 84, 118 in a predetermined relative position.

The forward portion of the weep connector 118 has a projecting nose 146 which defines spaced edges 148, 150 which abut to the downturned lip 64 and bottom wall 44 and downturned lip 64 and bottom wall 82, respectively, on the collection sections 40, 42. This projecting nose 146 covers, so as to conceal, the projecting lower portions of the side walls 48, 50 of the water collection sections 40, 42. The cooperation between a) the edges 148, 150 and the downturned lip 64 and bottom walls 44, 82 and b) the attachment portion 137 and the flange 102 on the diverting connector 104 causes the connector 118 to be consistently vertically located in the attached position shown in FIGS. 1 and 5.

To assemble the weep connector 118, the connector 118 can be situated so that it straddles the side walls 50, 80 at the top edges 54, 100 with the receptacle 143 over the flange 102 and thereafter press fit downwardly to the FIG. 1 position. The connector 118 can be configured so that bottom edges 152, 154 thereof abut to the bottom walls 44, 82 simultaneously as the underside of the top connector wall 126 abuts to the top edges 54, 102 of the side walls 50, 80. So assembled, the connector 118 maintains the water collection sections 40, 42 in the operative relationship, maintains a predetermined space between adjacent bricks 28 in the bottom course, and defines the venting passageway 119 from the external environment to the air space 34.

The weep connector 118 can be made from metal, plastic, composite, or other material. In the embodiment shown, the walls 122, 124 are "cut out" at 156, which reduces the required amount of material in the weep connector 118, as in the event that the connector 118 is formed by an injection molding process, or the like. Alternatively, the walls 122, 124 could extend fully to the bottom walls 44, 82, over the full fore-and-aft dimension thereof, or to a point between that shown and the full extension to the bottom walls 44, 82.

Alternatively the weep connector 118 and the diverting connector 81 can be fabricated as a single piece rather than two interlocking pieces The use of separate weep and diverting connectors, however, may facilitate shipping and storage.

With the water collection sections 40, 42, the diverting connector 84, and the weep connector 118 assembled as in FIG. 1, a sheet layer 158 extending over the sheathing 16 is directed downwardly past the bottom edge 159 of the sheathing 16 and over the top of the diverting connector 84, terminating at a point above the surface 101 on the cantilevered wall 98. On either side of the diverting connector 84, the bottom edge of the sheet 158 can extend down to the bottom wall 44. A depending portion 160 of the sheet 158 can be bonded to the wall 86, as by an adhesive 162. Accordingly, downwardly moving water in the space 34 is directed by the sheet 158 to forwardly of the wall 86. The surface 101 in turn diverts downwardly moving water so that it does not pass between the side walls 50, 80 on the water collection sections 40, 42. The surface 101, in conjunction with the top wall 126 of the connector 118, shields the space between the side walls 50, 80 so that water cannot migrate therebetween. Any downwardly moving water is thus accumulated in the water collection space 56 in the water collection section 40, and a corresponding water collection space 164 in the water collection section 42.

The individual water collection sections can be made in different lengths L (see FIG. 2). The sections 40, 42, and like sections, can be placed side-to-side over the entire running length of the veneer 26. By making available different lengths, the lengths can be mixed and matched to produce the desired overall length. Some sections may also be made without an end wall at one end so that special lengths may be fabricated at the time of installation.

Figure 8:
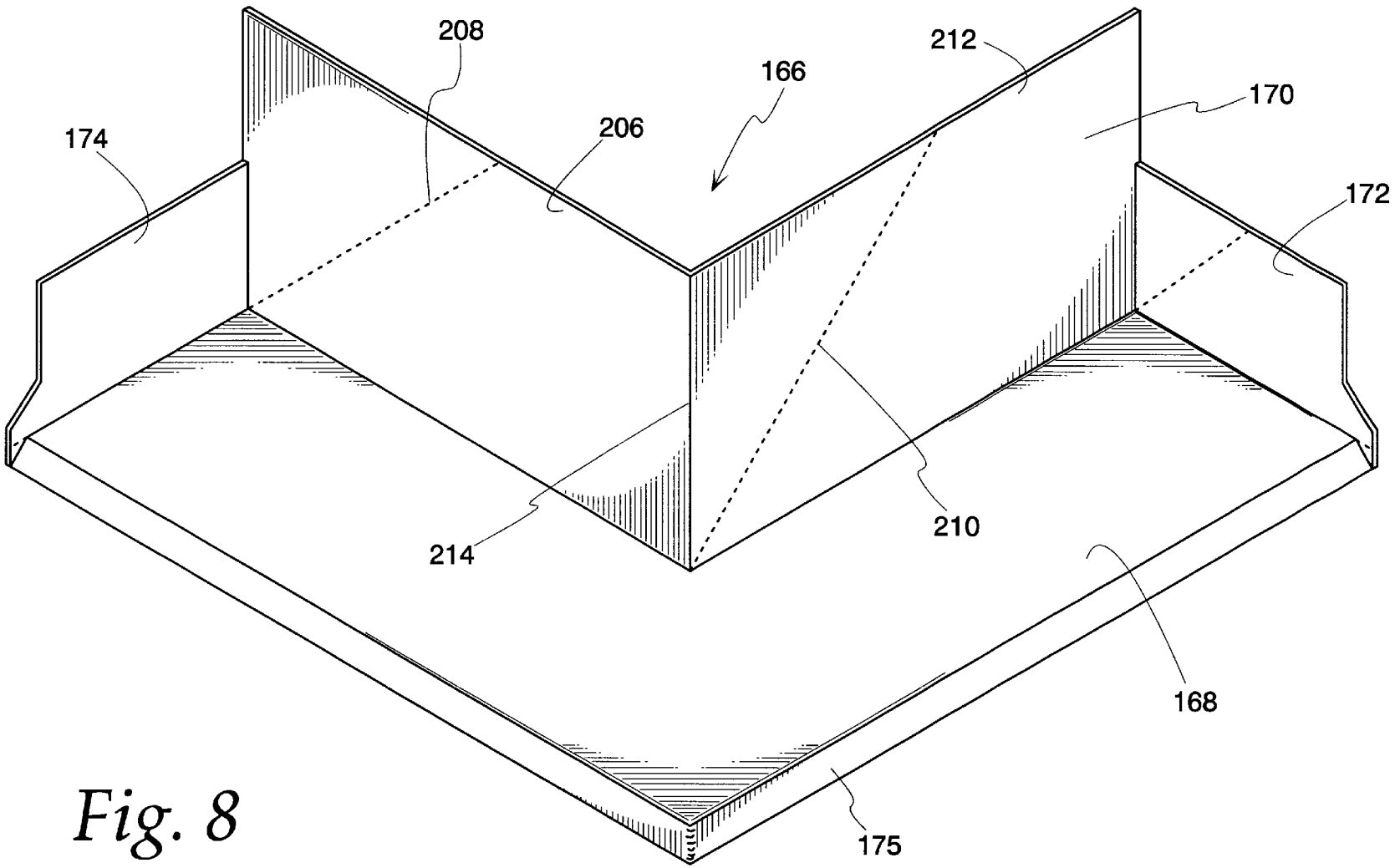
FIG. 8 is a perspective view of an outside corner water collection section for use in the wall system in FIG. 1, made according to the present invention and in an operative state.

A separate, outside corner water collection section can be utilized, as shown at 166 in FIG. 8. The corner section 166 has an L-shaped bottom wall 168 and L-shaped back wall 170 which terminate at walls 172, 174 which are positionable adjacent to and joinable by a connector 118 with the side walls 48, 50, 80, on adjacent water collection sections 40, 42, previously described, and like sections. The corner section 166 performs the same water collection function as do the sections 40, 42. A downturned lip 175 extends between the walls 172, 174 to direct accumulated moisture forwardly to away from the base 32.

Figure 9:
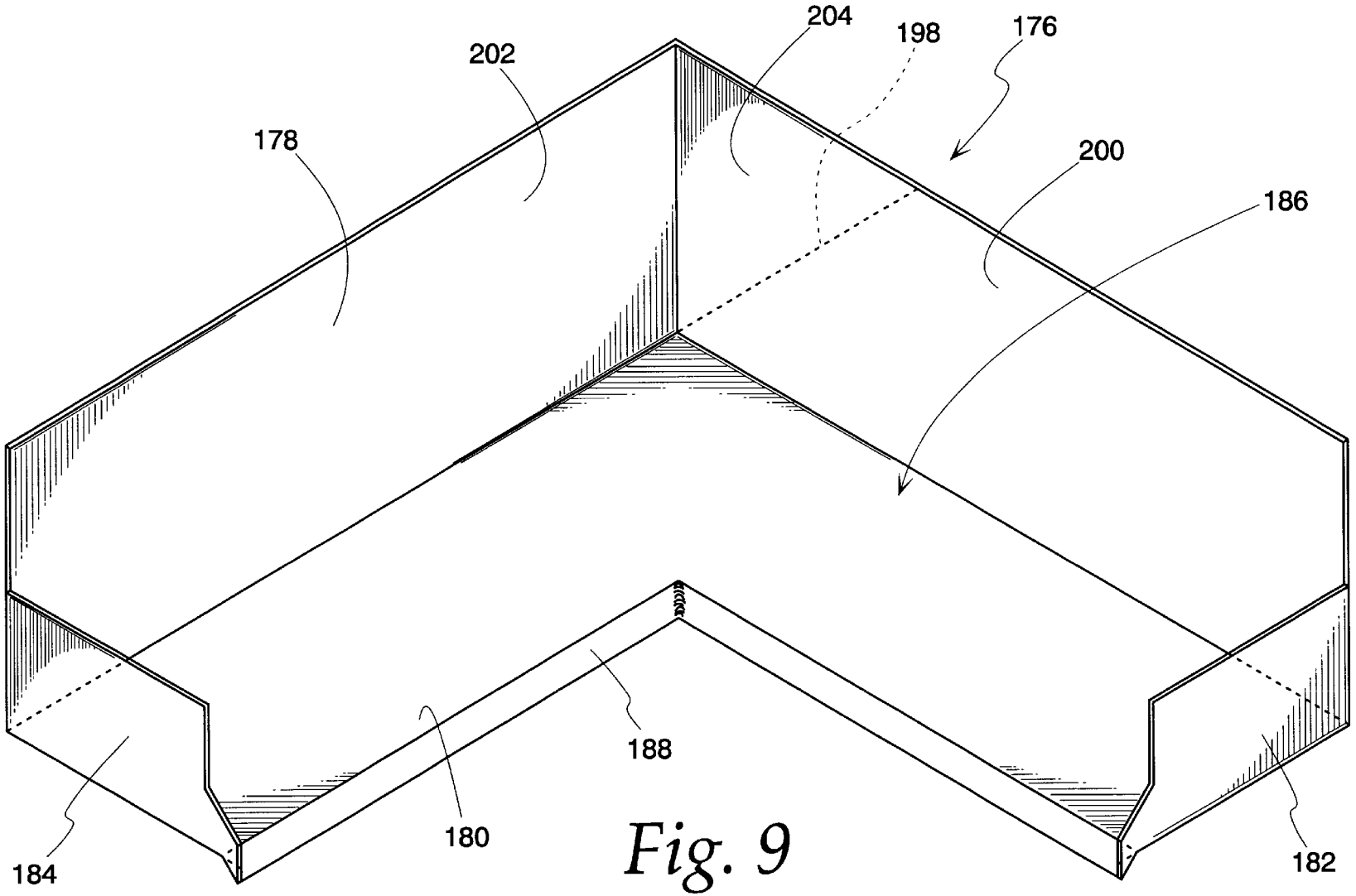
FIG. 9 is a perspective view of an inside corner water collection section, according to the present invention, in an operative state and useable on the wall system of FIG. 1.

In FIG. 9, an inside corner water collection section is shown at 176. The corner section 176 has an L-shaped rear wall 178 and an L-shaped bottom wall 180 which extend between walls 182, 184. The walls 178, 180, 182, 184 collectively bound a water collection space 186. The bottom wall 180 has a downturned lip 188 to direct accumulated water away from the top of the wall base 32 (FIG. 1). The walls 182, 184 cooperate in the same manner with adjacent collection sections 40, 42, and the like, as the walls 172, 174 as described with respect to FIG. 8.

Figure 10:
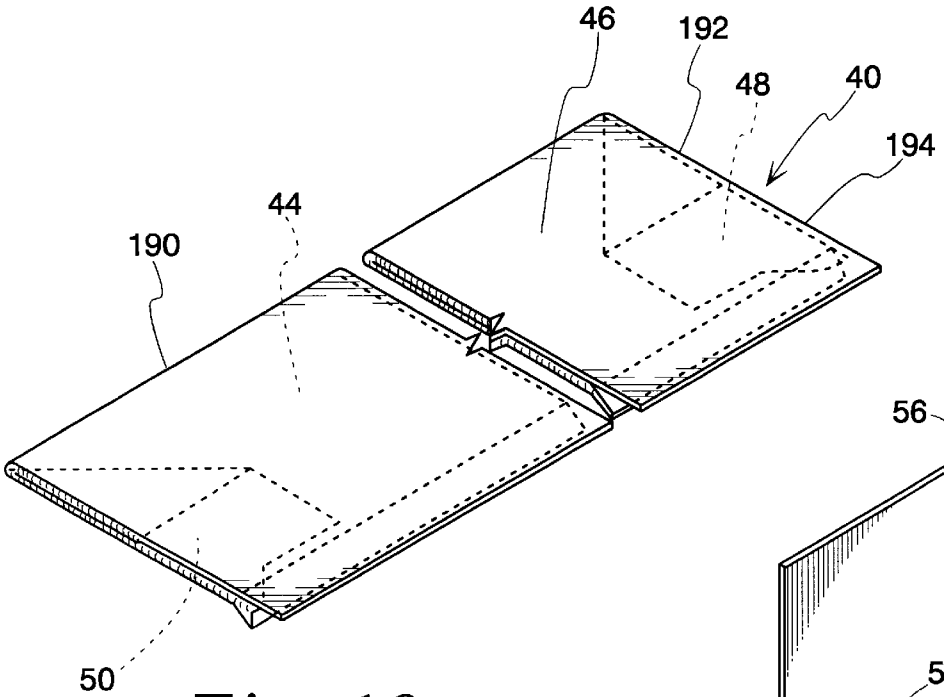
FIG. 10 is a perspective view of the water collection section of FIG. 2 in a collapsed state.

In one form of the invention, the collection sections 40, 42, 166, 176 can be folded to a compacted, collapsed state, as for storage and handling. The folding process for one exemplary water collection section 40 is shown in FIGS. 2 and 10. Folding is facilitated by forming hinge lines between parts which are relatively moved as part of the folding process so that the parts reposition in a predetermined manner. The fold lines may be made by any well known means, such as by compressing the material at the fold line, pre-creasing the material, etc.

The back wall 46 is joined to the bottom wall 44 at a hinge line 190. The side wall 48 is joined to the back wall 46 at a hinge line 192 and to the bottom wall 44 along a hinge line 194. A separate hinge line 196 is provided to allow the side wall 48 to be folded against itself.

The water collection section 40 is converted from the operative state in FIG. 2 to the collapsed state of FIG. 10 by folding the side wall 48 downwardly about the hinge line 194 towards the bottom wall 44. As this is taking place, the side wall 48 is formed into a V shape opening to the right in FIG. 2 about the hinge line 196 so that the back wall 46 is folded downwardly towards the bottom wall 44 as the side wall 48 is folded towards the bottom wall 44. The side wall 50 is simultaneously reconfigured in the same fashion as the side wall 48. With the collection section 40 in the collapsed state, each of the side walls 48, 50 is folded against itself and resides between the rear wall 46 and bottom wall 44.

Figure 11:
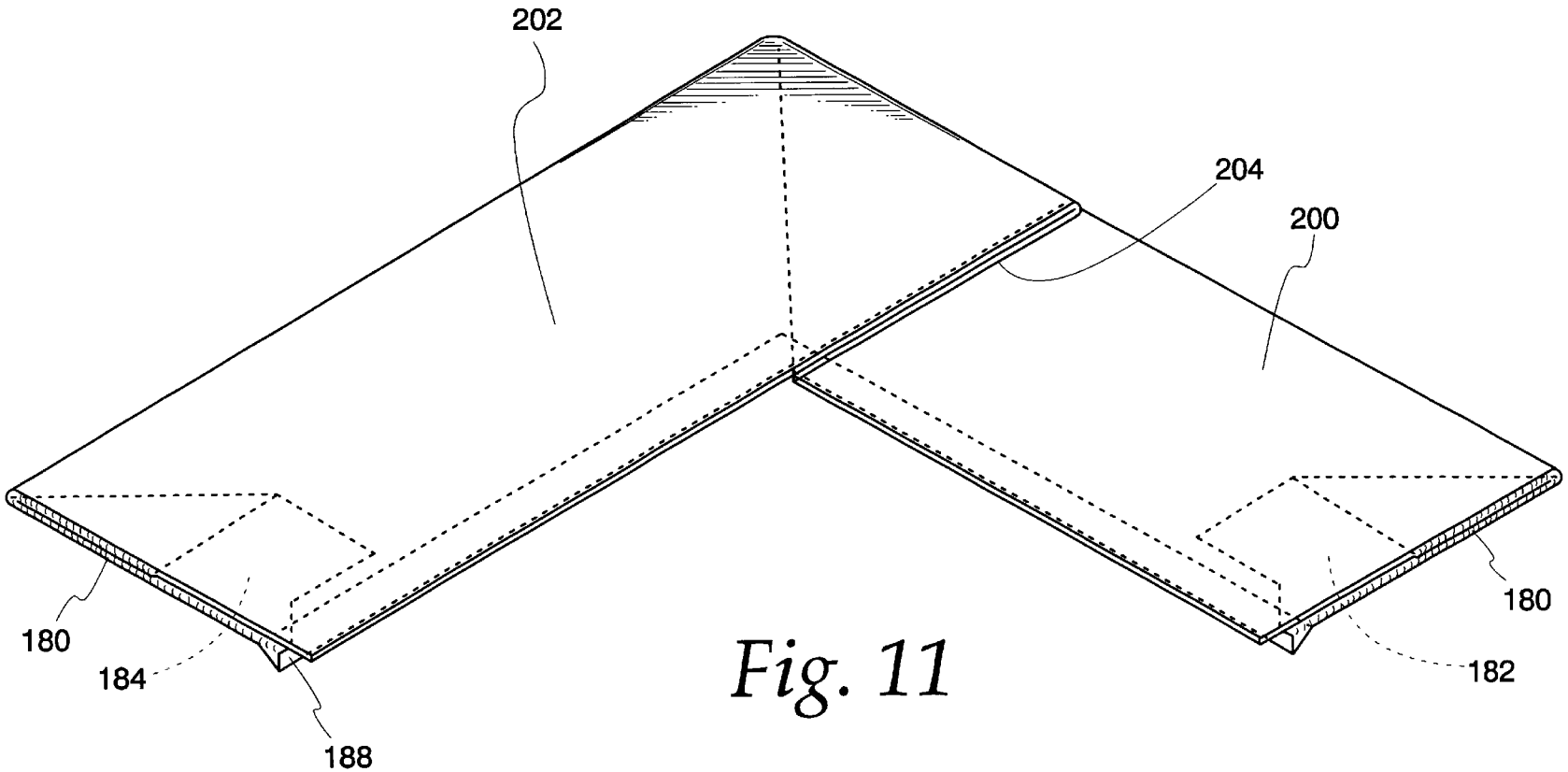
FIG. 11 is a perspective view of the water collection section in FIG. 9 in a collapsed state.

The inside corner section 176 in the operative state of FIG. 9 is similarly folded to a collapsed state in FIG. 11. The walls 182, 184 are folded downwardly relative to the bottom wall 180 and rear wall 178 in the same manner as the side walls 48, 50 are folded relative to the rear wall 46 and bottom wall 44 of the collection section 40 in FIG. 2 about corresponding hinge lines. Folding of the section 176 is different in that there is an additional hinge line 198 which allows one rear panel 200 on the rear wall 178 to be folded about the hinge line 198 in a V shape, opening towards the right in FIG. 9, which allows the panel 200 to be folded directly against the bottom wall 180 and the adjacent rear panel 202 to be folded downwardly against a triangularly-shaped portion 204 on the panel 200 which overlies the remainder of the panel 200.

Figure 12:
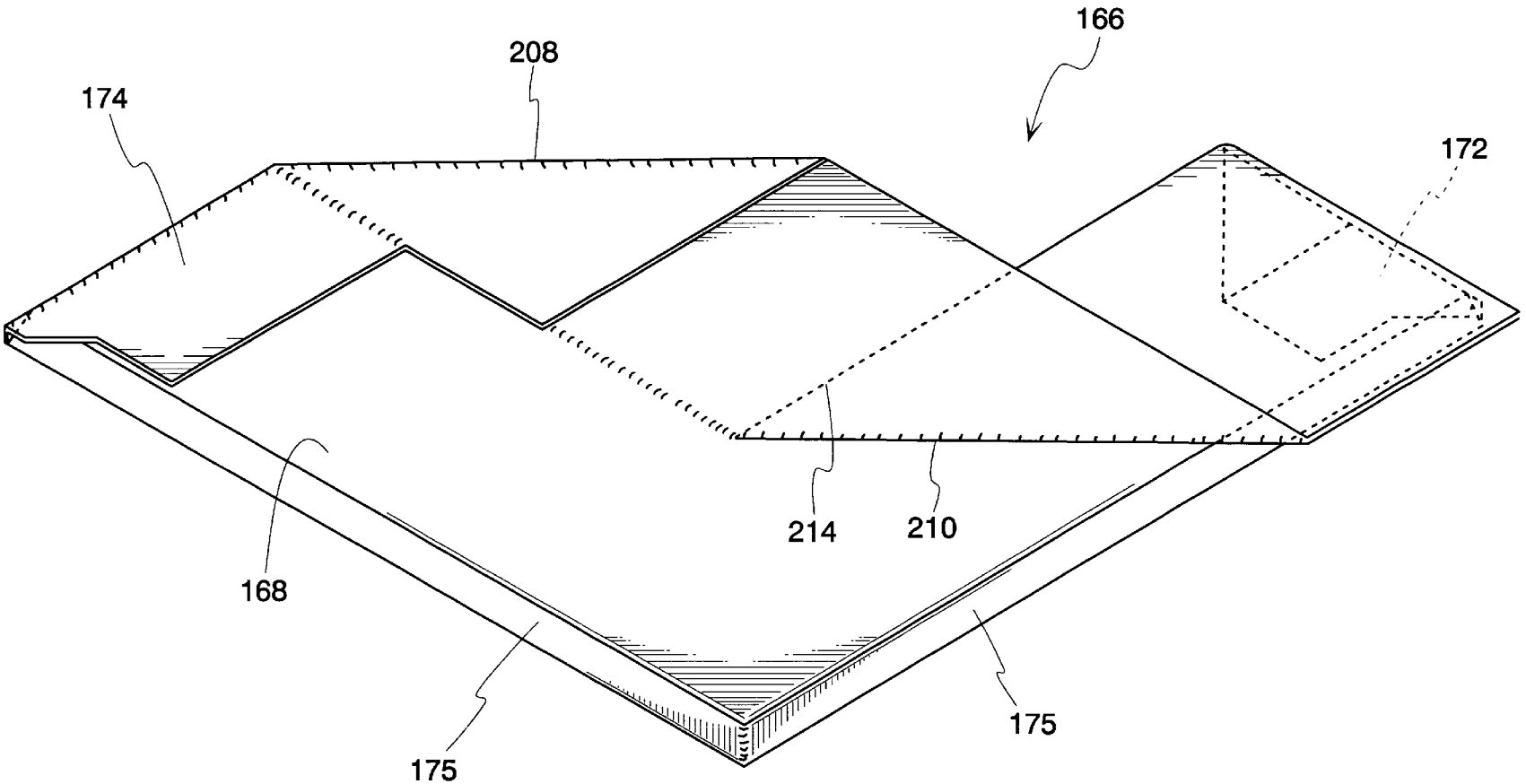
FIG. 12 is a perspective view of the water collection section of FIG. 8 in a collapsed state.

Folding of the outside corner section 166 is described with respect to FIGS. 8 and 12. Folding of the wall 172 relative to the rear wall 170 and bottom wall 168 is carried out in the same manner as the side wall 48 is folded relative to the rear wall 46 and bottom wall 44 on the collection section 40 in FIG. 2. A rear wall panel 206 is bent in a V shape opening to the left in FIG. 8 about a hinge line 208 to allow the wall 174 to be folded against the bottom wall 168. A hinge line 210 on the rear panel 212 allows the panel 212 to be folded in a V shape opening to the left about the hinge line 210 to allow the panel 212 to be folded downwardly against the bottom wall 168. A hinge line 214 between the panels 206, 212 allows the portions of the panels 206, 212 at the hinge lines 208, 210 to be placed in a flattened state.

The collection sections 40, 42, 166, 176 can be made from any material that permits folding. For example, the material could be a plastic or a metal material of gauge sufficient to create a downturned lip that is sufficiently durable to remain intact when exposed to the exterior environment.

The water collection sections 40, 42, 166, 167 can be placed in a collapsed state and stacked as shown in FIG. 17, as in a container 216. In this state, the collection sections 40, 42, 166, 176 can be compacted in volume to be conveniently stored, transported, and otherwise handled.

Figure 18:
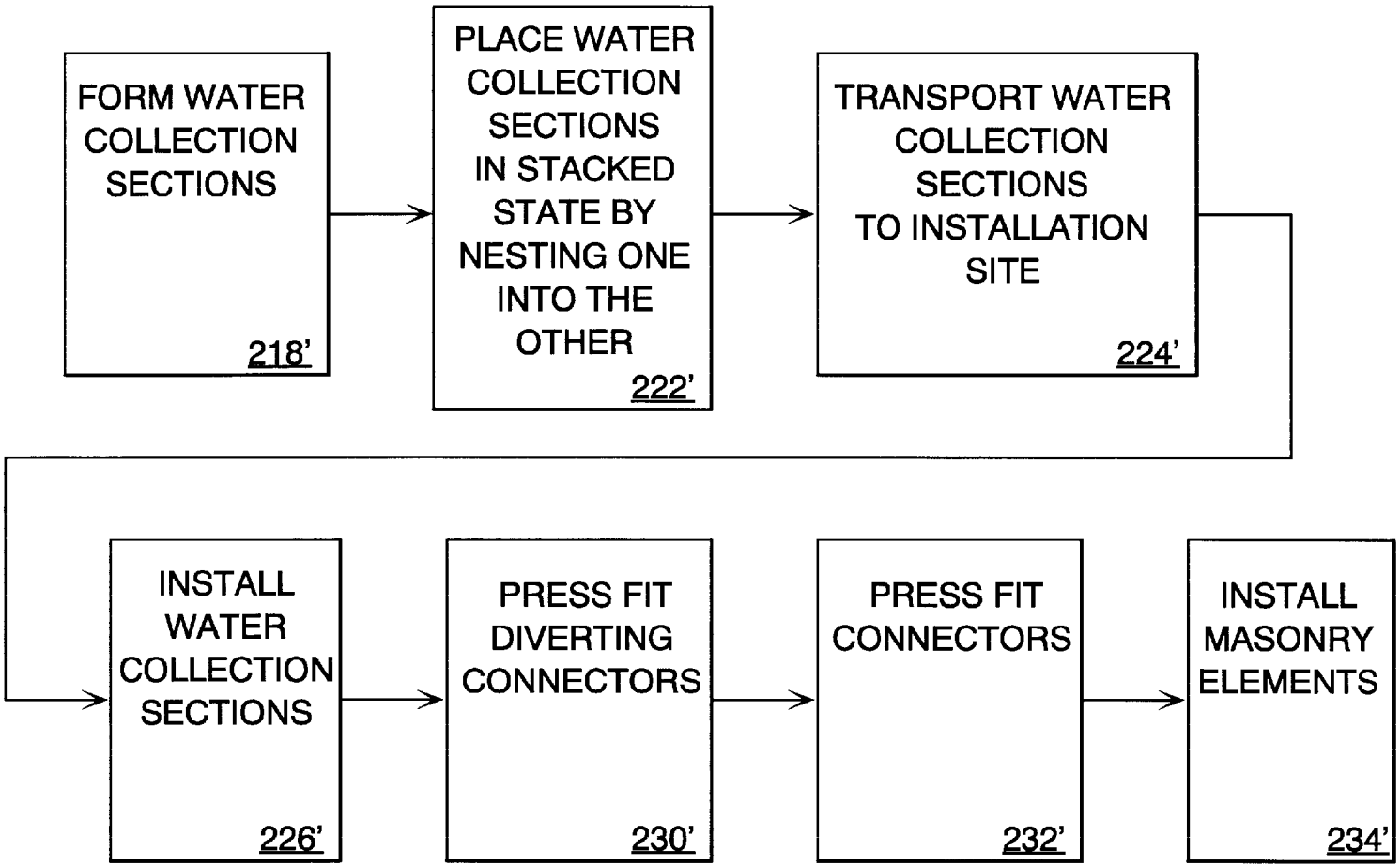
FIG. 18 is a schematic representation of a method of manufacturing, transporting, and installing water collection sections, according to the present invention, using sections that are nested and stacked for storage and shipping.

Alternatively, water collection sections 40, 42, 166, 167 can be fabricated with slightly angled back and side walls to permit nesting and stacking as shown schematically in FIG. 18.

Figure 16:
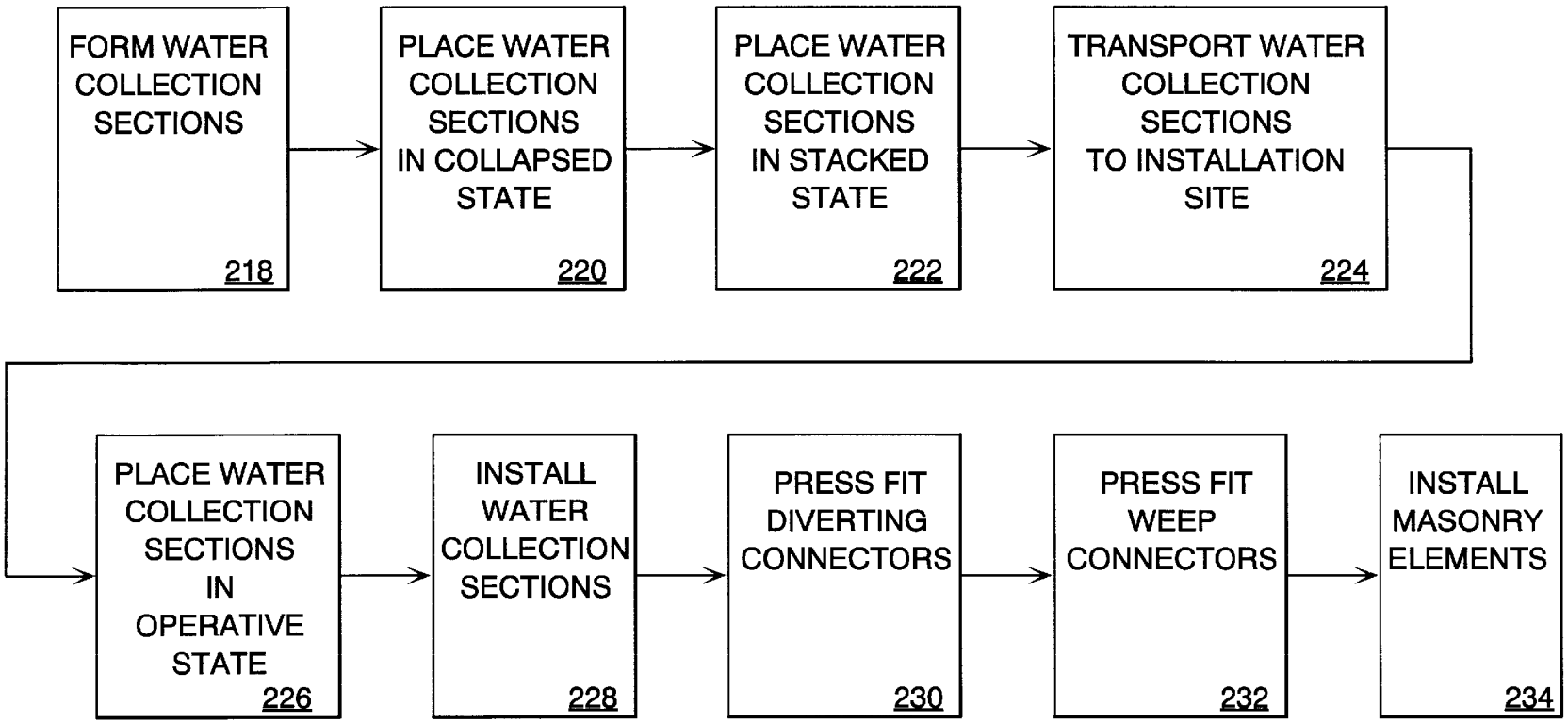
FIG. 16 is a schematic representation of a method of manufacturing, transporting, and installing a water collection system, according to the present invention, using sections that are folded and collapsed for storage and shipping.

One typical procedure that can be practiced according to the present invention using folded and collapsed sections is shown schematically in FIG. 16. Initially, the water collection sections 40, 42, 166, 176 are formed as indicated by the block 218. The water collection sections 40, 42, 166, 176 are then placed in a collapsed state as shown at block 220. The collapsed water collection sections 40, 42, 166, 176 are then placed in a stacked state, and may be placed in the container 216 in the stacked state, as shown at block 222. The water collections 40, 42, 166, 176 are then transported to an installation site, as shown at block 224. At the installation site, the water collection sections 40, 42, 166, 176 are placed in the operative state, as shown at block 226. The water collection sections 40, 42, 166, 176 in the operative state are then installed into operative relationship with each other, as shown at block 228. The diverting connectors 84 are then press fit into operative position over adjacent collection sections 40, 42, 166, 176, as shown at block 230. The weep connectors 118 are then press fit into an operative position over the side walls of adjacent collector sections 40, 42, 166, 176 and interlocked with the diverting connectors. While an adhesive may be used, the system can be constructed so that no adhesive is required between any of the parts thereof, i.e. the water collection sections 40, 42, 166, 176, the connectors 84, 118, etc. The masonry elements/bricks 28 are then installed, as shown at block 234.

An alternative procedure that can be practiced according to the present invention using stacked sections is shown schematically in FIG. 18. Initially, sections 40, 42, 166, 176 are formed as indicated by the block 218'. These sections are then stacked by nesting one into the other as indicated b block 222', and may be placed into a container for storage and transportation to the installation site, as shown in block 224'. At the installation site, the water collection sections 40, 42, 166, 176 are installed into operative relationship with each other, as shown at block 226'. The diverting connectors 84 are then press fit into operative position over adjacent collection sections 40, 42, 166, 176, as shown at block 230'. The weep connectors 118 are then press fit into an operative position over the side walls of adjacent collector sections 40, 42, 166, 176 and interlocked with the diverting connectors as shown at block 232'. The masonry elements/bricks 28 are then installed as shown at block 231.

Figure 13:
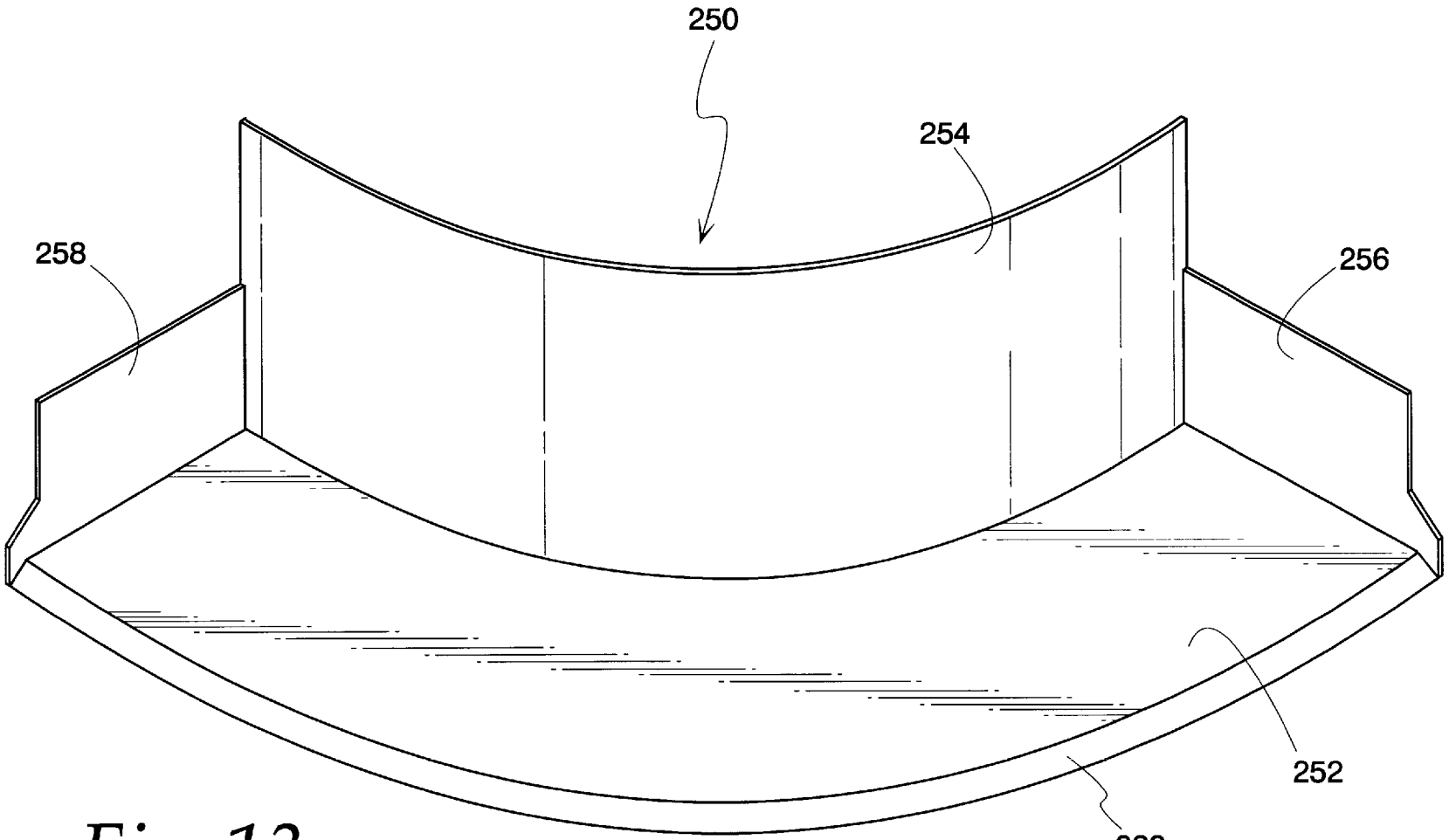
FIG. 13 is a perspective view of a water collection section for a radiused wall, according to the present invention, in an operative state.

Many variations, not disclosed, are contemplated by the invention. As just one example, as shown in FIG. 13, a water collection section for a radiused wall is shown at 250. The water collection section 250 has bottom and rear walls 252, 254, respectively, formed to the intended shape of the masonry veneer. The bottom and rear walls 252, 254 terminate at side walls 256, 258 for connection to adjacent water collection sections 40, 42, and the like, in a manner previously described. The bottom wall 252 has a downturned lip 260 for controlled water direction at the front of the section 250.

Figure 14:
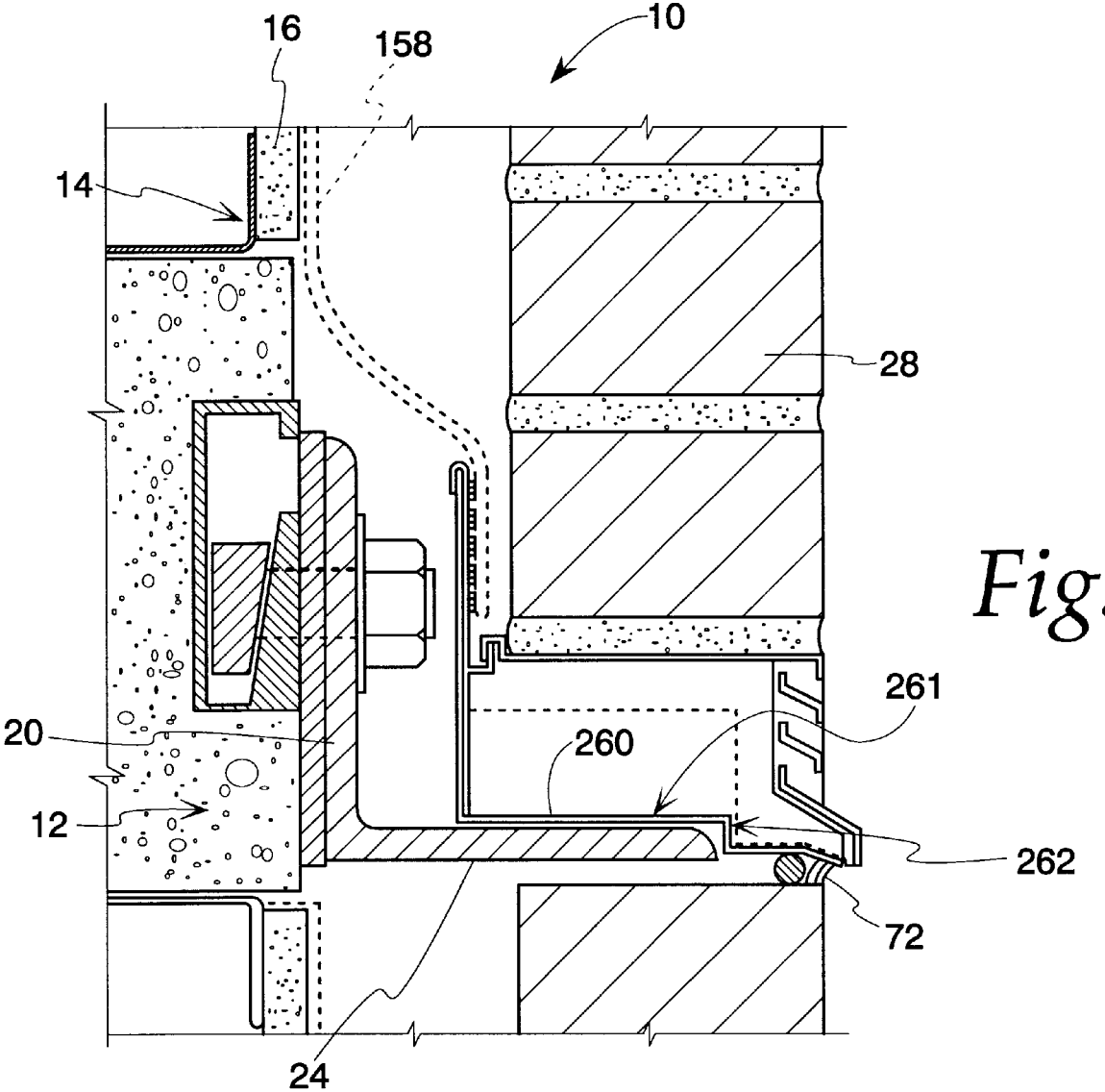
FIG. 14 is a cross-sectional view of a wall system, as in FIG. 1, with a modified form of water collection section, according to the invention, wherein the water collection section has a recessed bottom to conceal a steel angle.
Figure 15:
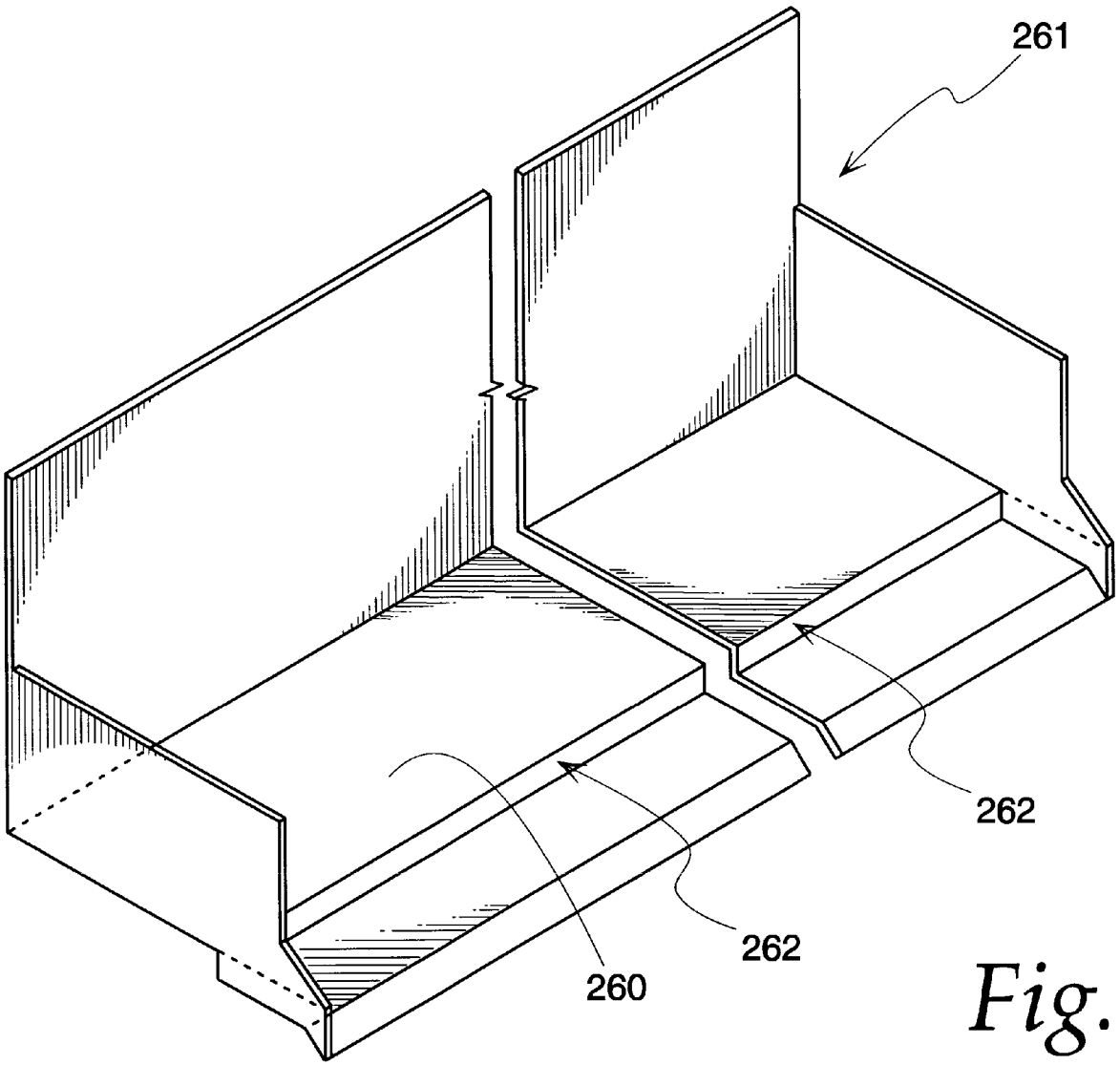
FIG. 15 is a perspective view of the water collection section of FIG. 14.

Another variation is shown in FIGS. 14 and 15 on the wall system 10, previously described. In this variation, a bottom wall 260 on a water collection section 261 contains a step 262 to conceal the horizontal leg of the angle 24. Adjacent sections would be joined using connectors 84 and 118 as previously described.

The foregoing disclosure of specific embodiments is intended to be illustrative of the broad concepts comprehended by the invention.

What is claimed is:

1. In combination:

a) a first water collection section for a masonry wall and comprising a first bottom wall, a first back wall, and a first side wall bounding a first collection space, the first side wall terminating at a first upper free edge, the first side wall having a substantially flat surface that extends from the first bottom wall to the first upper free edge;

b) a second water collection section for a masonry wall and comprising a second bottom wall, a second back wall, and a second side wall bounding a second collection space, the second side wall terminating at a second upper free edge, the second side wall having a substantially flat surface that extends from the second bottom wall to the second upper free edge; and c) a first connector for joining the first and second water collection sections to maintain the first and second water collection sections in an operative relationship wherein the first and second side walls are adjacent to each other.

2. The combination according to claim 1 wherein the first connector is separate from each of the first and second water collection sections and is capable of straddling the first and second side walls at the first and second upper free edges.

3. The combination according to claim 1 wherein the first connector defines a venting passageway.

4. The combination according to claim 1 wherein the first water collection section is reconfigurable selectively between an operative state and a collapsed state, the first water collection section being reconfigured from the operative state towards the collapsed state by folding the first side wall and first back wall downwardly towards the first bottom wall.

5. The combination according to claim 4 wherein there is a hinge line between the first side wall and first bottom wall and a hinge line between the first back wall and the first bottom wall, the hinge lines facilitating relative folding between the first bottom wall, the first side wall, and the first back wall.

6. The combination according to claim 1 wherein the first and second backwalls each have an upper edge, and further comprising a diverting connector which extends around the upper edges of the first and second back walls with the first and second water collection sections in the operative relationship and the diverting connector in an operative position.

7. The combination according to claim 6 wherein the diverting connector has an upwardly facing surface which bridges the first and second side walls with the first and second water collection sections in the operative relationship and the diverting connector in the operative position and diverts downwardly moving water from passage between the first and second side walls.

8. The combination according to claim 7 further comprising a sheet layer which depends from a location above the first and second water collection sections and extends in front of the diverting connector to a location below the upper edges of the first and second back walls to divert downwardly moving water towards the first and second collection spaces.

9. The combination according to claim 8 wherein at least a portion of the sheet layer terminates above the upwardly facing surface of the diverting connector so that downwardly moving water is directed by the sheet to against the upwardly facing surface of the diverting connector.

10. The combination according to claim 9 wherein a portion of the first connector overlies the upwardly facing surface of the diverting connector.

11. The combination according to claim 7 wherein the upwardly facing surface on the diverting connector terminates at an upturned flange.

12. The combination according to claim 6 wherein the diverting connector has a front wall which one of a) vertically spans substantially the entire vertical extent of the first and second back walls and b) spans only a part of the vertical extent of the first and second back walls and a U-shaped upper portion which wraps around the upper edges of the first and second back walls with the first and second water collection sections in the operative relationship and the diverting connector in the operative position.

13. The combination according to claim 6 wherein the diverting connector is made from at least one of plastic, metal and composite material.

14. The combination according to claim 1 wherein the first connector has a wall with a solid upwardly facing surface which bridges the upper edges of the first and second side walls to block passage of downwardly moving water to between the first and second side walls.

15. The combination according to claim 1 wherein the first connector has a front and rear and a plurality of vertically spaced surfaces at the front of the first connector.

16. The combination according to claim 15 wherein the plurality of vertically spaced surfaces decline from rear to front.

17. The combination according to claim 1 wherein the first water collection section is made from at least one of a plastic, metal, and composite material.

18. The combination according to claim 1 wherein the first water collection section comprises a third side wall which is spaced from the first side wall.

19. The combination according to claim 18 wherein the first side wall has a first flat surface and the third side wall has a third flat surface and the first and third flat surfaces are substantially parallel to each other.

20. The combination according to claim 1 wherein the first bottom wall has a front and rear and a downwardly bent lip at the front of the bottom wall.

21. The combination according to claim 20 wherein the downwardly bent lip defines a forward edge, the first side wall has a lower portion, and the lower portion of the first sidewall projects forwardly to or beyond the forward edge of the downwardly bent lip.

22. The combination according to claim 1 wherein with the first and second water collection sections in the operative relationship, the first and second side walls are spaced from each other by a predetermined distance.

23. The combination according to claim 22 wherein the first connector has a body defining a receptacle with a width that is slightly greater than the predetermined distance.

24. The combination according to claim 23 further comprising a plurality of masonry elements fixed to each other within the first collection space and a plurality of masonry elements fixed to each other within the second collection space, the body of the first connector has a width, the masonry elements are spaced from each other by a second predetermined distance in each of the first and second collection spaces, the first connector resides between a masonry element in the first collection space and a masonry element in the second collection space and the width of the body of the first connector is substantially equal to the second predetermined distance.

25. The combination according to claim 1 further comprising a plurality of masonry elements fixed to each other within the first collection space.

26. The combination according to claim 1 wherein the connector has a front wall with at least one vent opening therethrough.

27. The combination according to claim 1 wherein the first connector is attached to the first and second back walls.

28. In combination:

a) a first water collection section for a masonry wall and comprising a first bottom wall, a first back wall, and a first side wall bounding a first collection space;

b) a second water collection section for a masonry wall and comprising a second bottom wall, a second back wall, and a second side wall bounding a second collection space; and c) a first connector for joining the first and second water collection sections to maintain the first and second water collection sections in an operative relationship, wherein the first bottom wall has a front and rear and a downwardly bent lip at the front of the bottom wall, wherein the downwardly bent lip defines a forward edge, the first side wall has a lower portion, and the lower portion of the first sidewall projects forwardly to or beyond the forward edge of the downwardly bent lip, wherein the first connector has a projecting nose that extends over and conceals the lower portion of the first side wall that projects forwardly to or beyond the forward edge of the downwardly bent lip.

29. In combination:

a) a first water collection section for a masonry wall and comprising a first bottom wall, a first back wall, and a first side wall bounding a first collection space;

b) a second water collection section for a masonry wall and comprising a second bottom wall, a second back wall, and a second side wall bounding a second collection space;

c) a first connector for joining the first and second water collection sections to maintain the first and second water collection sections in an operative relationship, wherein the first and second back walls each have an upper edge; and d) a diverting connector which extends around the upper edges of the first and second back walls with the first and second water collection sections in the operative relationship and the diverting connector in an operative position, wherein the diverting connector has an upwardly facing surface which bridges the first and second side walls with the first and second water collection sections in the operative relationship and the diverting connector in the operative position and diverts downwardly moving water from passage between the first and second side walls, wherein the diverting connector has a front wall with an opening formed therethrough.

30. The combination according to claim 29 wherein the diverting connector has a horizontally extending wall portion defining the upwardly facing surface and the front wall comprises at least one flange which reinforces the horizontally extending wall portion on the diverting connector.

31. The combination according to claim 30 wherein the flange bounds the opening formed through the front wall of the diverting connector.

32. A method of forming a water collection structure for installation at the bottom of a masonry wall, the method comprising the steps of:

placing first and second water collection sections, each comprising a bottom wall and a wall structure extending upwardly from the bottom wall and including a back wall, in an operative relationship at a location at which masonry elements are to be placed; and press-fitting a first connector to the first and second water collection sections to thereby maintain the first and second water collection sections in the operative relationship and so that the first connector and first and second water collection sections are interengaged so as to limit relative movement between the first connector and first and second water collection sections in a fore-and-aft direction.

33. The method according to claim 32 wherein no separate fastener or adhesive is used to maintain the first connector and either of the first and second water collection sections together.

34. A method of forming a water collection structure for installation at the bottom of a masonry wall, the method comprising the steps of:

placing first and second water collection sections, each comprising a bottom wall and a wall structure extending upwardly from the bottom wall, in an operative relationship at a location at which masonry elements are to be placed;

press-fitting a first connector to the first and second water collection sections to thereby maintain the first and second water collection sections in the operative relationship; and press-fitting a second connector to the first and second water collection sections so that the second connector diverts downwardly moving water so as not to pass between and under the first and second water collection sections.

35. The method according to claim 34 wherein the second connector is press-fit by direction downwardly against the wall structure.

36. The method according to claim 34 wherein the first connector is press-fit by direction downwardly against the wall structure.

37. A method of forming a water collection structure for installation at the bottom of a masonry wall, the method comprising the steps of:

placing first and second water collection sections, each comprising a bottom wall and a wall structure extending upwardly from the bottom wall, in an operative relationship at a location at which masonry elements are to be placed;

press-fitting a first connector to the first and second water collection sections to thereby maintain the first and second water collection sections in the operative relationship; and reconfiguring the first water collection section prior to press-fitting the first connector to the first and second water collection sections.

38. The method according to claim 37 wherein the first water collection section has an operative state and a collapsed state, the first connector is press fit to the first water collection section with the first water collection section in the operative state, the first water collection section is changeable from the operative state towards the collapsed state by folding the wall structure downwardly towards the bottom wall.

39. The method according to claim 38 wherein the step of reconfiguring comprises changing the first water collection section from the collapsed state into the operative state.

40. The method according to claim 39 further comprising the step of shipping a plurality of water collection sections having the same configuration as the first water collection section to a site at which the masonry wall is to be constructed with the plurality of water collection sections in the collapsed state and stacked one against the other.

41. In combination:

a) a first water collection section for a masonry wall and comprising a first bottom wall, a first back wall, and a first side wall bounding a first collection space, the first bottom wall having a downturned lip defining a forward edge; and b) a first connector for engaging the first side wall and joining the first water collection section to another water collection section to maintain the first and another water collection sections in an operative relationship, the first side wall having a lower portion projecting forwardly to or beyond the forward edge of the downwardly bent lip, the connector having a projecting nose which covers the lower portion of the first side wall projecting forwardly to or beyond the forward edge of the downwardly bent lip.

42. In combination:

a) a first water collection section for a masonry wall and comprising a first bottom wall, a first back wall, and a first side wall bounding a first collection space;

b) a second water collection section for a masonry wall and comprising a second bottom wall, a second back wall, and a second side wall bounding a second collection space;

c) a first connector for joining the first and second water collection sections to maintain the first and second water collection sections in an operative relationship, wherein the first and second back walls each have an upper edge; and d) a diverting connector which extends around the upper edges of the first and second back walls with the first and second water collection sections in the operative relationship and the diverting connector in an operative position.

43. In combination:

a) a first water collection section for a masonry wall and comprising a first bottom wall, a first back wall, and a first side wall bounding a first collection space;

b) a second water collection section for a masonry wall and comprising a second bottom wall, a second back wall, and a second side wall bounding a second collection space; and c) a first connector for joining the first and second water collection sections to maintain the first and second water collection sections in an operative relationship, wherein the first bottom wall has a front and rear and a downwardly bent lip at the front of the bottom wall.

44. In combination:

a) a first water collection section for a masonry wall and comprising a first bottom wall, a first back wall, and a first side wall bounding a first collection space;

b) a second water collection section for a masonry wall and comprising a second bottom wall, a second back wall, and a second side wall bounding a second collection space;

c) a first connector for joining the first and second water collection sections to maintain the first and second water collection sections in an operative relationship; and d) a plurality of masonry elements fixed to each other within the first collection space.

45. In combination:

a) a first water collection section for a masonry wall and comprising a first bottom wall, a first back wall, and a first side wall bounding a first collection space;

b) a second water collection section for a masonry wall and comprising a second bottom wall, a second back wall, and a second side wall bounding a second collection space;

c) a first connector for joining the first and second water collection sections to maintain the first and second water collection sections in an operative relationship, wherein with the first and second water collection sections in the operative relationship, the first and second side walls are in adjacent relationship, each of the first and second side walls has an upper edge and the first connector straddles the first and second side wall sections at the upper edges of the first and second side walls, wherein with the first and second water collection sections in the operative relationship, the first and second side walls are spaced from each other by a predetermined distance, wherein the first connector has a body defining a receptacle with a width that is slightly greater than the predetermined distance; and d) a plurality of masonry elements fixed to each other within the first collection space and a plurality of masonry elements fixed to each other within the second collection space, wherein the body of the first connector has a width, the masonry elements are spaced from each other by a second predetermined distance in each of the first and second collection spaces, the first connector resides between a masonry element in the first collection space and a masonry element in the second collection space and the width of the body of the first connector is substantially equal to the second predetermined distance.

* * * * *